US007600748B2

(12) United States Patent
Takai et al.

(10) Patent No.: US 7,600,748 B2
(45) Date of Patent: Oct. 13, 2009

(54) SHEET FEEDING DEVICE WITH CONCAVE SUCTION BELT

(75) Inventors: Shingo Takai, Ibaraki (JP); Yasushi Hashimoto, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/213,096

(22) Filed: Jun. 13, 2008

(65) Prior Publication Data

US 2008/0308999 A1 Dec. 18, 2008

(30) Foreign Application Priority Data

Jun. 15, 2007 (JP) ..... P2007-158298

(51) Int. Cl.
*B65H 3/46* (2006.01)

(52) U.S. Cl. ..... 271/106; 271/94; 271/98; 271/197

(58) Field of Classification Search ..... 271/94, 271/98, 106, 197
See application file for complete search history.

(56) References Cited

U.S. PATENT DOCUMENTS 2,806,614 A * 9/1957 Butz ..... 414/416.09
4,618,138 A * 10/1986 Silverberg ..... 271/245
4,635,921 A 1/1987 Thomas
2007/0200283 A1* 8/2007 Kott et al. ..... 271/101

FOREIGN PATENT DOCUMENTS

JP 2541526 7/1996
JP 2005-1855 1/2005

* cited by examiner

*Primary Examiner*—Patrick H Mackey
*Assistant Examiner*—Gerald W McClain
(74) *Attorney, Agent, or Firm*—McGinn IP Law Group, PLLC

(57) ABSTRACT

According to an aspect of the present invention, there is provided a sheet feeding device including: a tray holding sheets; a chamber having an opening and generating a negative pressure thereinside; a suction belt that suctions and conveys a first sheet from the sheets and that is configured to be rotatable along with the chamber and deformable into a concave shape along with the opening; a regulating member disposed inside the opening to regulate a concaving amount of the suction belt; a sheet gate disposed in a sheet feeding passage to be opposed to the suction belt and configured to retreat when contacted by the suction belt; and a nozzle that blows air toward the sheet and toward the suction belt.

5 Claims, 3 Drawing Sheets

SHEET FEEDING DEVICE WITH CONCAVE SUCTION BELT

CROSS-REFERENCE TO RELATED APPLICATIONS

The entire disclosure of Japanese Patent Application No. 2007-158298 filed on Jun. 15, 2007 including specification, claims, drawings and abstract is incorporated herein by reference in its entirety.

BACKGROUND OF THE INVENTION

1. Field of the Invention

An aspect of the present invention relates to a sheet feeding device of an electro-photographic apparatus, and particularly to the sheet feeding device using an air stream.

2. Description of the Related Art

FIGS. 1 and 2 are diagrams illustrating a configuration of a pneumatic sheet feeding device in an electro-photographic apparatus disclosed in JP-2005-1855-A. As shown in FIG. 1, sheets 2 are mounted on a sheet elevating table 1. The sheet elevating table 1 is controlled by a control unit 4 based on a detected result of a sheet upper surface detecting sensor 3, thereby positioning the sheets 2 at a given height. A suctioning chamber 5, a suction belt 6 having plural holes for passing air therethrough and a driving device 7 which drives the suction belt 6 are disposed above the sheets 2.

At the front position in a sheet feeding direction, a nozzle 8 that blows air toward the upper sheets to float the upper sheets is provided. The suction belt 6 performs conveying by suctioning the sheets 2 floated by the nozzle 8 and feeding the sheets. On the downstream of the sheet feeding direction, a conveying roller 13 is provided for receiving the fed sheets 2 and conveying the sheets 2 to an image forming unit (not shown).

Like a top vacuum corrugation sheet feeding device disclosed in Japanese Patent No. 2541526, there is related art sheet feeding device in which a unit for deforming a sheet suctioned in the central portion of plural suction belts is provided to blow an air stream into a space between sheets and to separate the sheets from each other, and a gate for preventing the subsequent sheets of a second sheet from being fed is provided.

In recent years, a printing process of an electro-photographic apparatus is inclined to increase, and high-speed printing has generally been used. Moreover, the types of sheets used in the printing are diversified. As a result, a demand for more rapid and reliable feeding capability has been increased. On the other hand, a demand for reducing manufacturing cost has been increased as well.

SUMMARY OF THE INVENTION

In view of the above-mentioned problems, an object of the invention is to provide a sheet feeding device capable of preventing double-sheet feeding with high reliability and reducing manufacturing cost.

According to an aspect of the present invention, there is provided a sheet feeding device including: a sheet mounting tray that holds sheets; a chamber that has an opening formed therein and that generates a negative pressure thereinside; a suction belt that suctions a first sheet from the sheets and conveys the first sheet and that is configured to be rotatable along with the chamber and deformable into a concave shape along with the opening; a regulating member that is disposed inside the opening to regulate a concaving amount of the suction belt; a sheet gate that is disposed in a sheet feeding passage so as to be opposed to the suction belt and that is configured to retreat when contacted by the suction belt; and a nozzle that includes: first blowing ports that are disposed in both end portions with respect to the suction belt to blow air toward the sheets; and a second blowing port that is disposed in a central portion with respect to the suction belt to blow air toward the suction belt.

The sheet gate may include a claw that is configured to move when contacted by the suction belt. The claw may be positioned so that a gap is formed between the claw and the suction belt where deformed into the concave shape to pass the first sheet therethrough.

The sheet gate may be configured to be adjustable in a vertical direction to change a distance between the sheet gate and the suction belt.

The suction belt may be controlled to rotate in a reverse direction of a sheet feeding direction after a printing process is stopped.

The suction belt may have holes punched therein. An area of the opening may be larger than a total area of the holes.

According to such a configuration, a sheet feeding device capable of performing high speed printing, surely preventing double-sheet feeding, and reducing manufacturing cost is provided.

BRIEF DESCRIPTION OF THE DRAWINGS

Embodiments of the present invention will be described in detail based on the following figures, wherein.

DETAILED DESCRIPTION OF THE INVENTION

Figure 1:
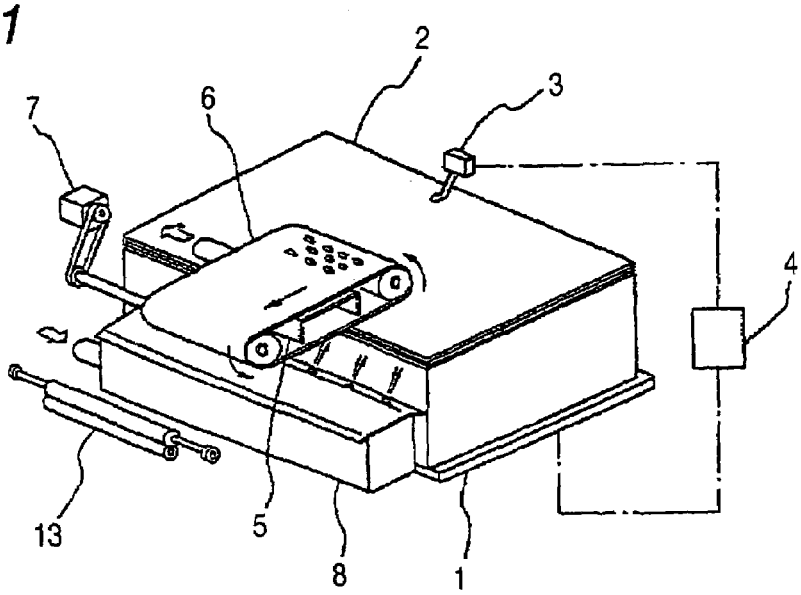
FIG. 1 is a perspective view illustrating related art sheet feeding device.
Figure 2:
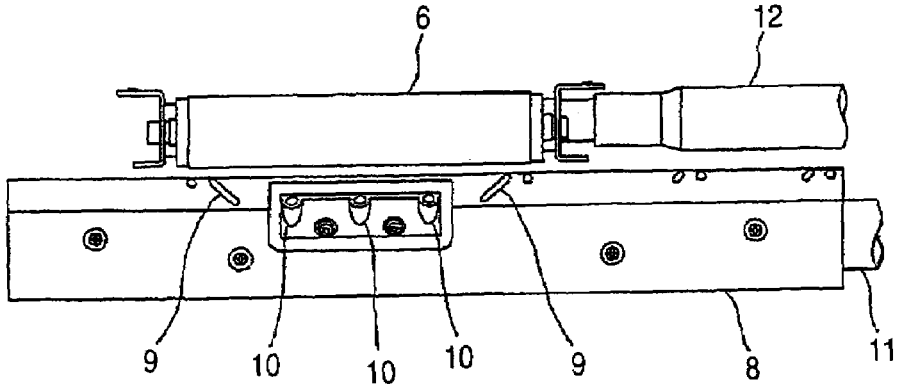
FIG. 2 is a front view illustrating the related art sheet feeding device.

In a sheet feeding device according to an aspect of the present invention, after a first sheet is suctioned onto a suction belt by a negative pressure, the suction belt is suctioned to the inside of a suctioning chamber to be deformed into a concave shape, thereby deforming the suctioned first sheet. At this time, since a second sheet can not follow the concave shape formed in the suction belt and the first sheet due to its rigidity, a space may occur between the first and the second sheets. Since an air stream flows into the space from a second blowing port of a nozzle, sheets are separated, thereby preventing the double-sheet feeding.

Plural suction belts are not required to be provided since deformation of the suction belt by the negative pressure improves separation of the sheets. Accordingly, since additional components for the plural suction belts are not required, a construction of an apparatus becomes simplified, thereby reducing manufacturing cost.

A sheet control gate is provided in a conveying passage of a sheet so as to be opposed to the suction belt and controls subsequent sheets of the second sheet which follow the first sheet. Accordingly, it is possible to improve the separation of the sheets more effectively. In this case, as the space between the sheet control gate and the suction belt is smaller, effect for preventing double-sheet feeding is improved. On the other hand, a space of some extent has to be maintained in order to prevent damage caused due to contact of the sheet control gate with the suction belt. According to an aspect of the present invention, it is possible to avoid the damage by configuring the sheet control gate as a claw-shaped member since the claw-shaped member is pushed by the suction belt so as to be retreated when the negative pressure is not applied to the suction belt and therefore the concave shape is not formed.

Further, by configuring the sheet control gate so that the position thereof is adjustable in a vertical direction to arbitrarily change a gap with the suction belt, an appropriate gap between the sheet control gate and the suction belt can be selected in accordance with a sheet type. Therefore, a double-sheet feeding is surely prevented for more kinds of sheets.

Further, a trouble with a sheet conveying passage may occur and a sheet may remain between the suction belt and the sheet control gate. By configuring the suction belt to rotate in a reverse direction of the sheet conveying direction after stop of the printing, a problem does not occur at the time of starting the next printing since the remaining sheet can be automatically ejected.

According to an aspect of the present invention, there is provided the sheet feeding device includes: the suctioning chamber that generates a negative pressure through an opening formed thereon; the suction belt that suctions and feeds the sheets and that is configured to be rotatable along with the suctioning chamber and deformable into a concave shape at the opening of the suctioning chamber; a regulating member that is disposed inside the suctioning chamber so as to be stepped with respect to the opening of the suctioning chamber and that regulates a concave amount of the suction belt; the sheet control gate that is disposed in a sheet feeding passage so as to be opposed to the suction belt and that is configured to retreat when contacted by the suction belt; and the nozzle that includes first blowing ports that are disposed in both end portions with respect to the suction belt to blow air toward the sheets and second blowing ports that are disposed in the central portion with respect to the suction belt to blow air toward the suction belt. After the printing process is stopped, the suction belt rotates in a reverse direction of a sheet feeding direction.

Figure 3:
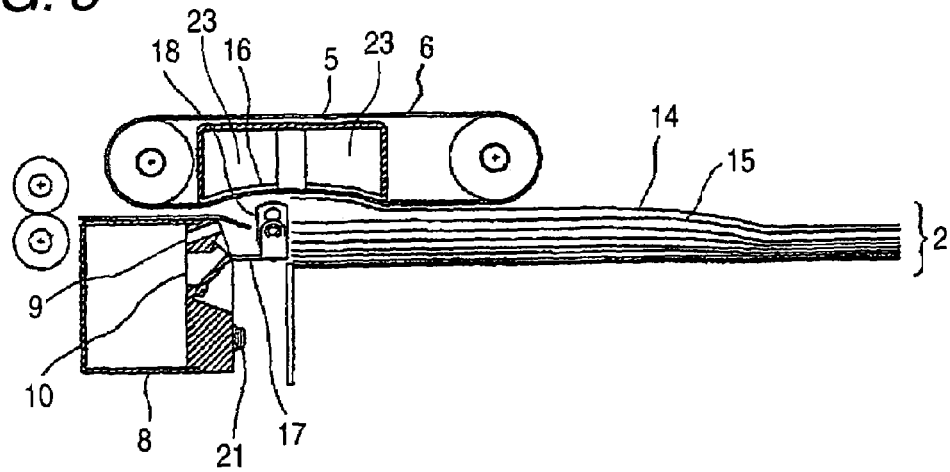
FIG. 3 is a side sectional view illustrating a sheet feeding device according to an embodiment of the present invention.
Figure 4:
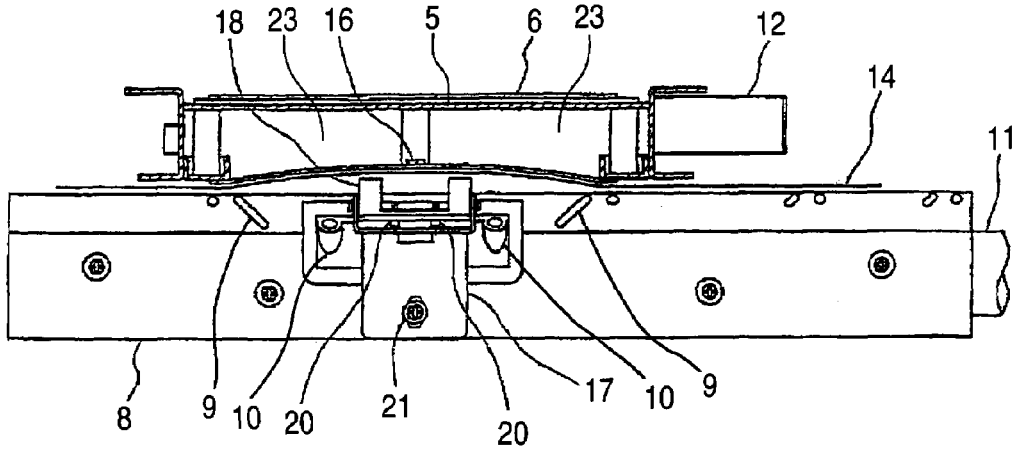
FIG. 4 is a front view illustrating the sheet feeding device.

Hereinafter, an embodiment of the present invention will be described with reference to the drawings. FIGS. 3 and 4 show the embodiment. In the drawings, Reference Numeral 2 indicates sheets, Reference Numeral 6 indicates a suction belt formed of a rubber member, and Reference Numeral 8 indicates a nozzle having first blowing ports 9 for blowing air toward the upper portion of the sheets 2 and second blowing ports 10 for blowing air toward the suction belt 6. Air is supplied to the nozzle 8 through a duct 11 by a blowing device (not shown). Air in a suctioning chamber 5 is suctioned through the duct 12 to generate the negative pressure. The suction belt 6 rotates in contact with an opening 23 formed on the suctioning chamber 5. The sheets 2 are suctioned by the suction belt 6 through holes punched on the surface of the suction belt 6.

As shown FIG. 4, the first blowing ports 9 are disposed in both end portions with respect to the suction belt 6, and the second blowing ports 10 are disposed in the central portion with respect to the suction belt 6.

Figure 7:
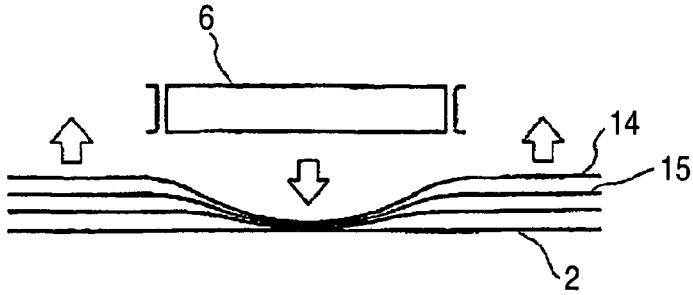
FIG. 7 is a schematic view showing an operation principle of the sheet feeding device.
Figure 8:
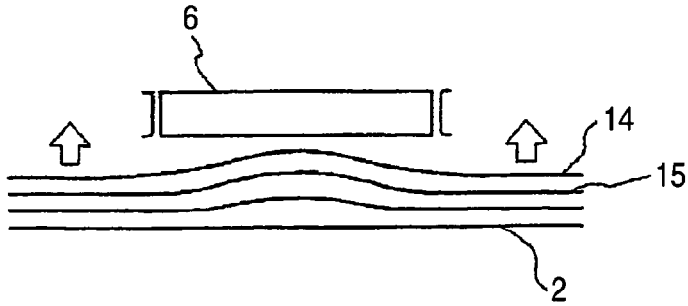
FIG. 8 is a schematic view showing the operation principle of the sheet feeding device.
Figure 9:
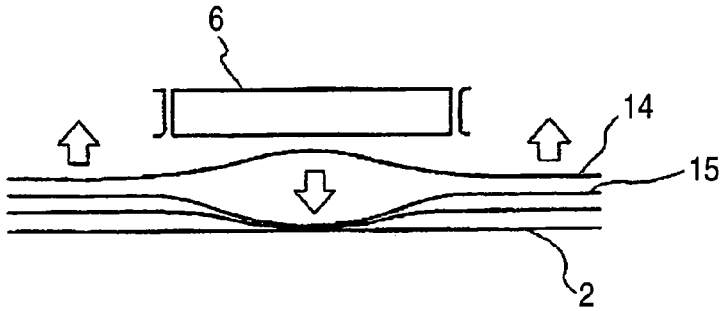
FIG. 9 is a schematic view showing the operation principle of the sheet feeding device.
Figure 10:
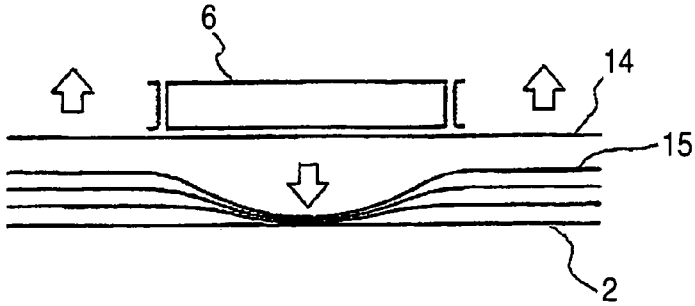
FIG. 10 is a schematic view showing the operation principle of the sheet feeding device.

An operation of feeding the sheet 2 in the sheet feeding device configured in this way will be described with reference to FIGS. 7 to 10. First, as shown in FIG. 7, both ends of the sheets 2 are separated and floated by the air blown from the first blowing port 9. When the suction belt 6 is rotated and the holes formed on the suction belt 6 are arrived at the opening 23 of the suctioning chamber 5, the suction is started. Then, a first sheet (uppermost sheet) 14 is raised, and thus the subsequent sheets below the first sheet 14 are also raised, as shown in FIG. 8. During the approach of the first sheet 14 to the suction belt 6, air blown from the second blowing port 10 flows into a space between the first sheet 14 and the second sheet 15, thereby separating the first sheet 14 and the second sheet from each other, as shown in FIG. 9. Afterward, the first sheet 14 reaching the suction belt 6 is conveyed by the rotation of the suction belt 6, as shown in FIG. 10. If the air stream does not sufficiently flows into the space between the first sheet 14 and the second sheet 15 during the process shown in FIG. 9 in the series of the feeding operation, the sheets are attached to each other, and thus double-sheet feeding arises.

For that reason, in the embodiment, as shown in FIGS. 3 and 4, an area of the opening 23 of the suctioning chamber 5 is configured to be sufficiently larger than a total area of the holes of the suction belt 6. In addition, when the first sheet 14 is suctioned, the suction belt 6 is configured so as to be suctioned into the inside of the suctioning chamber 5 by a negative pressure to be deformed into the concave shape. Accordingly, the first sheet 14 suctioned in this way is deformed along the concave shape of the suction belt 6, and the second sheet 15 can not follow the shape of the first sheet 14 due to its rigidity. Therefore, a space is formed between the first sheet 14 and the second sheet 15.

With such a configuration, the air stream surely flows into the space between the first sheet 14 and the second sheet 15 from the second blowing port 10, thereby improving the separation of sheets. Since the sheets are fed while improving the separation property thereof by using the deformation of the suction belt, only one suction belt is necessary and the additional suction belt is not necessary. Further, since components required for the additional suction belt are not necessary, it is possible to supply the sheet feeding device at low manufacturing cost.

A concave amount of the suction belt 6 is changed depending on the negative pressure. If the strength of the negative pressure is irregular, the concave shape becomes also irregular, and thus the separation of the sheets is not stabilized. For that reason, in the embodiment, a regulating member 16 is provided so that the suction belt 6 suctioned into the inside of the suctioning chamber 5 does not excessively concaved.

Figure 5:
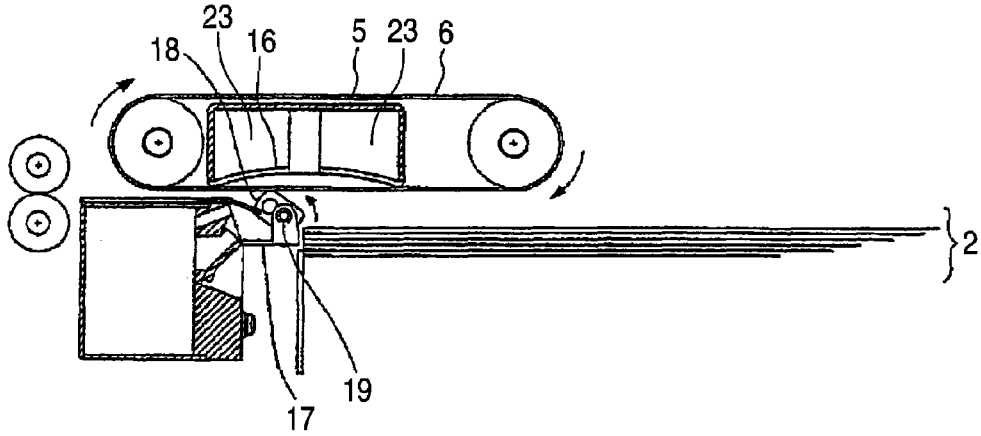
FIG. 5 is a side sectional view illustrating an operation of the sheet feeding device.

In the embodiment, as shown in FIGS. 3 and 4, a sheet control gate 17 is mounted in a sheet conveying passage opposed to the suction belt 6 to prevent the subsequent sheets of the second sheet from being conveyed through the contact friction when the first sheet 14 is conveyed. With such a configuration, it is possible to further improve the effect of preventing the double-sheet feeding. On the other hand, in a case where the negative pressure is not applied to the suction belt 6 and the concave shape is not formed, the suction belt 6 may be damaged due to contact of the sheet control gate 17 with the suction belt 6. For that reason, in the embodiment, as shown in FIG. 5, the sheet control gate 17 is constituted by a claw-shaped member 18 and a hinge 19 moving in contact with the suction belt 6. When the sheet control gate 17 comes in contact with the suction belt 6, the claw-shaped member 18 rotates on the hinge 19 to be retreated from the suction belt 6, thereby preventing the damage of the suction belt 6. In this embodiment, a spring 20 is connected to the claw-shaped member 18 and urges the claw-shaped member 18 to be quickly returned to a position shown in FIG. 3. Alternatively, the claw-shaped member 18 may be designed to be returned to the position by its weight without providing the spring 20.

As a distance between the suction belt 6 and the claw-shaped member 18 is smaller, the effect for preventing the double-sheet feeding is better. However, a feeding failure may occur depending on a type of a sheet. For example, a thick sheet has a higher rigidity than that of a thin sheet. Therefore, if the distance is not enough large, the feeding failure may occur due to a resistance of the suction belt 6 and the claw-shaped member 18. For that reason, in this embodiment, the sheet control gate 17 is configured so as to move in upward and downward directions by fixing the sheet control gate 17 with a screw 21. With such a configuration, it is possible to adjust the distance between the suction belt 6 and the claw-shaped member 18 according to the type of a sheet. As a result, a capability for dealing with types of sheets is improved.

Figure 6:
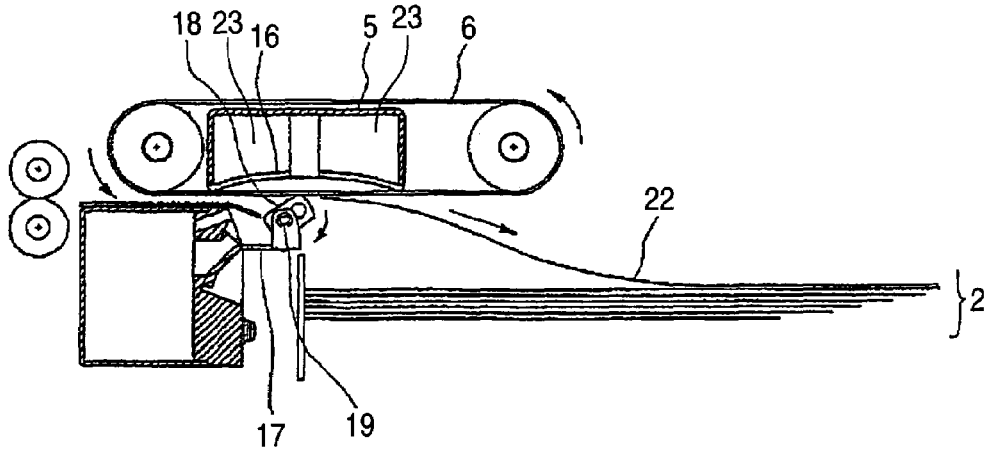
FIG. 6 is a side sectional view illustrating the operation of the sheet feeding device.

In the embodiment, when a sheet jamming occurs during printing and a sheet remains between the suction belt 6 and the claw-shaped member 18, the suction belt 6 is controlled to stop the printing and then to rotate in a reverse direction of the sheet conveying direction. Accordingly, as shown in FIG. 6, the remaining sheet 22 can be returned in a direction of a sheet tray. Therefore, inconvenience does not happen in the next printing.

The concave amount of the suction belt 6 and the distance between the suction belt 6 and the claw-shaped member 18 are adjusted according to types of sheets to be used and other setting conditions. In the embodiment, by setting the concave amount of the suction belt 6 to 3.5 mm, and by setting the distance between the suction belt 6 in the concaved state and the claw-shaped member 18 to 2 to 3 mm, a good result is obtained for a sheet having a weight of from 64 to 200 g/m2.

According to an aspect of the present invention, it is possible to provide a pneumatic sheet feeding device capable of preventing the double-sheet feeding and reducing manufacturing cost.

What is claimed is:

1. A sheet feeding device comprising:

a sheet mounting tray that holds sheets;

a chamber that has an opening formed therein and that generates a negative pressure thereinside;

a suction belt that suctions a first sheet from the sheets and conveys the first sheet and that is configured to be rotatable along with the chamber and deformable into a concave shape along with the opening;

a regulating member that is disposed inside the opening to regulate a concaving amount of the suction belt;

a sheet gate that is disposed in a sheet feeding passage so as to be opposed to the suction belt and that is configured to retreat when contacted by the suction belt; and a nozzle that includes:

first blowing ports that are disposed in both end portions with respect to the suction belt to blow air toward the sheets; and a second blowing port that is disposed in a central portion with respect to the suction belt to blow air toward the suction belt.

2. The sheet feeding device according to claim 1, wherein the sheet gate includes a claw that is configured to move when contacted by the suction belt, and wherein the claw is positioned so that a gap is formed between the claw and the suction belt where deformed into the concave shape to pass the first sheet therethrough.

3. The sheet feeding device according to claim 1, wherein the sheet gate is configured to be adjustable in a vertical direction to change a distance between the sheet gate and the suction belt.

4. The sheet feeding device according to claim 1, wherein the suction belt is controlled to rotate in a reverse direction of a sheet feeding direction after a printing process is stopped.

5. The sheet feeding device according to claim 1, wherein the suction belt has holes punched therein, and wherein an area of the opening is larger than a total area of the holes.

* * * * *